United States Patent [19]

Waite

[11] 4,378,325

[45] Mar. 29, 1983

[54] PROCESS FOR QUENCHING MELT-SPUN FILAMENTS

[75] Inventor: Roland Waite, Matthews, N.C.

[73] Assignee: Fiber Industries, Inc., New York, N.Y.

[21] Appl. No.: 251,815

[22] Filed: Apr. 7, 1981

Related U.S. Application Data

[62] Division of Ser. No. 149,370, May 13, 1980, Pat. No. 4,285,646.

[51] Int. Cl.[3] ..... D01D 3/00

[52] U.S. Cl. ..... 264/176 F; 264/237

[58] Field of Search ..... 264/176 F, 237; 425/72 S

[56] References Cited

U.S. PATENT DOCUMENTS

| | | | |
|---|---|---|---|
| 3,650,716 | 3/1972 | Brossard | 65/6 |
| 3,781,393 | 12/1973 | Feltgen et al. | 264/89 |
| 3,969,462 | 7/1976 | Stofan | 264/237 |
| 4,259,048 | 3/1981 | Miani | 264/237 |

FOREIGN PATENT DOCUMENTS

| | | | |
|---|---|---|---|
| 52-27815 | 3/1977 | Japan | 264/237 |
| 53-9293 | 4/1978 | Japan | 264/237 |

*Primary Examiner*—Jay H. Woo

*Attorney, Agent, or Firm*—Roderick B. Macleod

[57] ABSTRACT

Disclosed is a melt-spinning process of the type wherein molten polymer is extruded downwardly through a fiber pack and through coaxial circular rows of holes of a spinneret to form a circularly arranged group of filaments. Quench gas is directed across the filaments emerging from the spinneret, and the cooled filaments are gathered and redirected at a guide, which may be stationary or rotating. The quench gas is delivered by a conduit extending downwardly through the pack and spinneret coaxially relative to the rows of holes and then redirected and discharged laterally outwardly through the group of filaments above the guide.

3 Claims, 3 Drawing Figures

PROCESS FOR QUENCHING MELT-SPUN FILAMENTS

This is a divisional application of application Ser. No. 149,370, filed May 13, 1980, now U.S. Pat. No. 4,285,646.

BACKGROUND AND OBJECTS OF THE INVENTION

The present invention relates to the manufacture of melt spun polymeric filaments and, in particular, to the quenching of spun filaments emerging from the spinneret.

The manufacture of melt spun polymeric filaments is typically achieved by extruding a molten polymer, such as polyester, polyamide, etc., through a spinneret and then cooling the filaments thus formed. Therebelow, the filaments are converged and gathered at a guide and delivered to a bobbin or further treatment station.

The manner in which the filaments are cooled has a significant impact on the resulting quality of the filaments. A typical cooling technique involves a gas quench in which cool air is blown across the filaments as they emerge from the spinneret. In instances where the filaments are extruded in the form of a circular array, it is common to utilize an outflow quench technique in which the filaments are passed downwardly in surrounding relation to an upwardly extending air pipe, the latter being arranged generally coincident with the central axis of the group of filaments. Quench air is directed radially or laterally outwardly through the filament group from an upper, apertured end of the pipe, the air preferably dispersed by a porous sheathing surrounding the apertures. There is thus produced a controlled cooling of the filaments. For example, see U.S. Pat. Nos. 3,135,811; 3,259,681; 3,858,386; and 3,969,462. There has also been prior public use for more than one year of the apparatus shown in FIGS. 1A and 1B.

In FIGS. 1A, 1B there is depicted a conventional melt-spinning apparatus 10 wherein a conventional filter pack 12 carries a conventional spinneret 14 through which is downwardly extruded a molten polymer such as polyester or polyamide for example, to form filaments. The spinneret is of a conventional type comprising holes arranged in an annular pattern so that a group 15 of circularly arranged filaments 16 is formed. The holes of the spinneret are preferably arranged in a series of circular rows having a common central axis. The spun filaments are split into two groups and travel downwardly to two turning guides 9, or godets or rolls, at which they are gathered and redirected, in conventional fashion.

The pack 12 is mounted on a conventional superstructure 20, and the filaments travel downwardly within a cabinet 22 closed at least on three sides and possibly open at the fourth side for operator monitoring purposes.

Quench gas in the form of air is provided to cool the filaments 15 emerging from the spinneret. The quench gas is delivered through an upwardly extending quench gas conduit 1 which includes a gas supply portion 2 and a gas discharge portion 3, which comprises a perforated hole pattern to obtain a required profile. The gas supply portion extends horizontally into the group of filaments and forms an elbow 4. Openings are provided in the gas discharge portion to discharge quench air radially outwardly, with the desired profile, through the surrounding filaments. A porous sheath 5 surrounds the gas discharge portion to uniformly disperse the discharging air.

The upper end of the conduit 1 includes a pin 6 which is received in an opening of the spinneret 14 to prevent lateral displacement of the conduit 1.

As is apparent from FIG. 1B, the filaments 16 are separated into two bunches 7, 8 to avoid contacting the elbow portion of the conduit 1. The separate filament bunches are gathered and redirected at a pair of turning guides 9.

In operation, quench air is delivered via the conduit 1 and is discharged radially outwardly from within the group of filaments emerging from the spinneret. The quenched filaments are separated into bunches 7, 8 and are gathered and redirected at the guides 9 for collection, or further treatment.

It will be appreciated that the conduit 1 is often of substantial height, thereby increasing the overall height of the machine and rendering it difficult to maintain the conduit in alignment with the longitudinal axis defined by the filament group. This arrangement also renders it difficult to maintain constant the distance from the spinneret to the uppermost quench air stream. Air gaps 16A are formed between the filament bunches 7, 8 which gaps promote undesirable air turbulence. To limit the ability of the filaments to contact the elbow, the diameter of the conduit 1 is minimized, but this restricts the quantity of air flow that can be conducted and also increases the pressure drop.

As previously indicated, the lower portion of the air pipe forms an elbow and passes horizontally through the group of filaments above the turning guide. In order to prevent the downwardly converging group of filaments from rubbing against the elbow, the pipe diameter is minimized and the filament group is divided into two bundles, each bundle fed to a separate turning guide, as depicted herein in FIG. 1B, for example.

The minimization of the air pipe diameter at low pressures below 5 psi results in the quantity of air flow being less than that normally desired for optimum cooling performance. In addition, enlarged air gaps are formed between the separated bundles, which gaps promote air turbulence, non-uniform quenching of the filaments, and increased drag action on the filaments. Also, the extra handling of the filaments increases the overall wear and tear to which they are subjected.

As regards the air pipe itself, the elbow must be placed at a level sufficiently below the quench zone to allow the filaments to be effectively divided into separate bundles. This results in a relatively long air pipe height which increases the overall machine height and renders it difficult to maintain the pipe aligned with the central axis of the filament group to assure that uniform quenching action is achieved.

It will be understood that the vertical distance between the extrusion holes of the spinneret and the uppermost stream of cooling air is of critical importance regarding the quality of filaments being produced. It is thus required that a predetermined distance be maintained at all times, a feat not easily accomplished with an air pipe of relatively great height which is anchored somewhere at its lower end remote from the spinneret.

It will also be appreciated that the splitting of the filament group into bundles considerably limits the available free area around the filament travel path and thus restricts the operator's access.

It is, therefore, an object of the present invention to minimize or obviate problems of the type discussed above.

Another object of the invention is to provide a filament quench which does not require the passage of a conduit laterally into the filament group.

It is an additional object of the invention to provide a filament quench which quenches all filaments equally and minimizes the action of air drag and air turbulence on the filaments.

A further object of the invention is to provide a filament quench which maximizes the quantity of quench gas flow attainable.

Another object of the invention is to provide a filament quench which prevents unlubricated filaments from being dragged across a surface, and therefore minimizes wear and tear on the filaments.

BRIEF SUMMARY OF THE INVENTION

These objects are achieved by the present invention in which molten polymer is extruded downwardly through a fiber pack and through a circular row of holes of a spinneret to form a circularly arranged group of filaments. Quench gas is directed across the filaments emerging from the spinneret, and the filaments are gathered and redirected at a guide. The quench gas is delivered downwardly through the pack and spinneret coaxially relative to the plurality of holes and then redirected and discharged outwardly through the group of filaments above the guide.

The quench gas is supplied by a gas supply conduit extending downwardly through the pack and the spinneret coaxially relative to the row of holes.

THE DRAWINGS

The objects and advantages of the invention will become apparent from the following detailed description of a preferred embodiment thereof in connection with the accompanying drawings in which like numerals designate like elements, and in which.

DETAILED DESCRIPTION OF A PREFERRED EMBODIMENT OF THE INVENTION

Figure 1A:
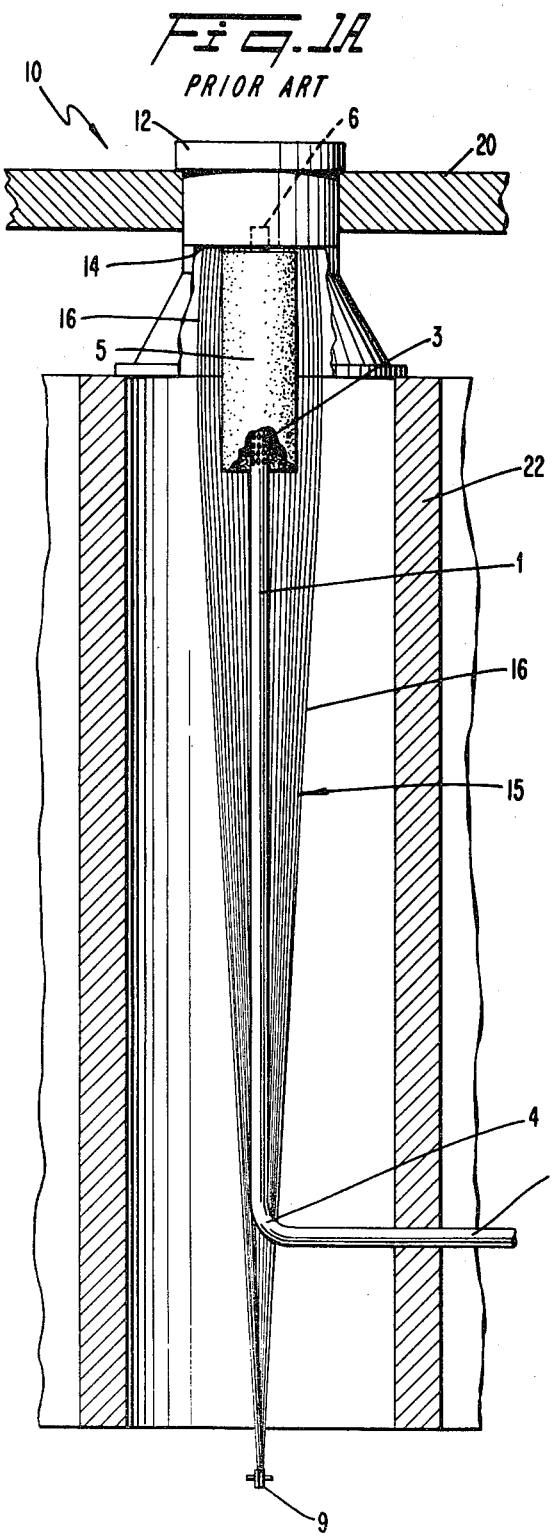
FIG. 1A PRIOR ART
FIG. 1A is a front view in vertical section of a melt-spinning apparatus according to the prior art.
Figure 1B:
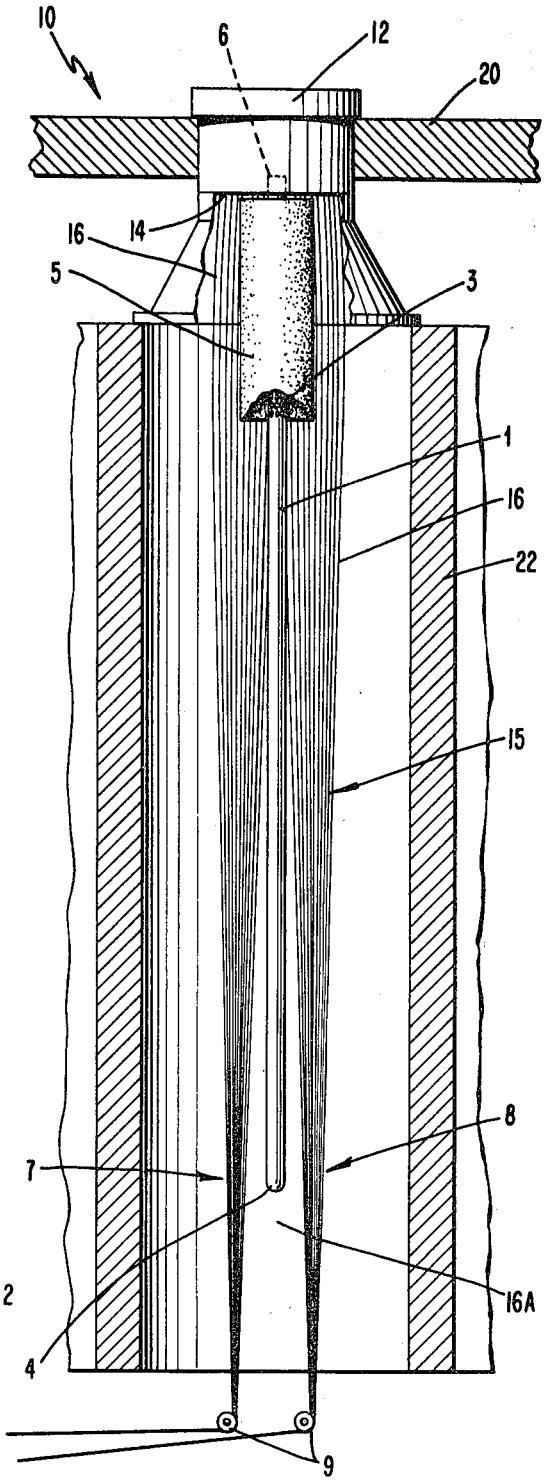
FIG. 1B PRIOR ART
FIG. 1B is a view similar to FIG. 1A but observed from the side to illustrate the separation of filaments into bunches.
Figure 2:
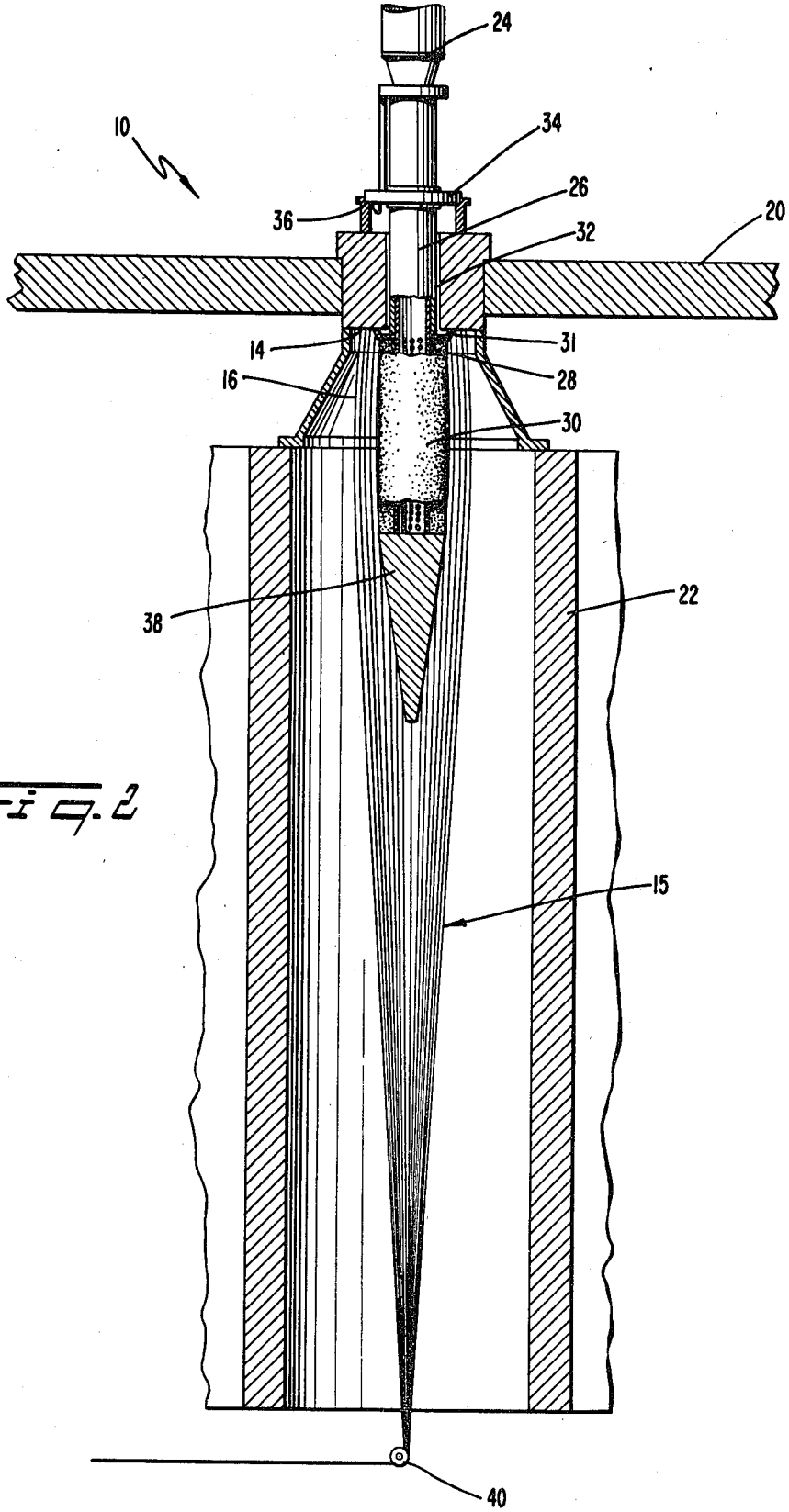
FIG. 2 is a vertical sectional view through a melt-spinning machine according to the present invention.

A preferred embodiment of the apparatus of this invention is depicted in FIG. 2. Quench gas is delivered by a quenching conduit 24 which includes a gas supply portion 26 and a gas discharge portion 28. The gas supply portion 26 extends downwardly through the pack 12 and spinneret 14 in coaxial relationship with the axis defined by the circular arrays of spinneret holes. Thus, in contrast to the prior art, the presence of an elbow below the quench is eliminated.

The gas discharge portion 28 is disposed immediately below the spinneret 14 and includes a plurality of outlet openings for discharging the quench air laterally outwardly with the desired profile, through the surrounding filaments 16. It will, of course, be appreciated that the hole arrangement for a given profile with this invention is necessarily different from the hole arrangement of the prior art. Preferably, a sheath of porous foam 30 surrounds the conduit discharge portion to uniformly disperse the quench air. A collar 31 may be located on the conduit 24 to position the sheath.

It will be appreciated that quench air passes through the filaments, bellowing them radially outwardly.

The section of the gas supply portion 26 extending through the pack 12 is preferably surrounded by an air gap 32 to minimize heat exchange between the quench gas and molten polymer within the pack 12. Alternatively, or in addition, that section of the gas supply portion 26 could be covered with thermal insulation.

The gas supply conduit 24 includes a fixed stop collar 34 which rests upon a stop shoulder 36 on the pack to support the supply conduit 24 and fixedly locate the latter relative to the spinneret. In this fashion, the spacial relationship between the spinneret holes and the uppermost stream of quench gas is maintained constant, to achieve uniformity of the quenching action and reduce birefringence variance in the filaments produced. These improvements occur within and between melt-spinning positions.

Extending downwardly from the lower end of the discharge portion 28 of the conduit is a gas streamlining member 38 in the form of a downwardly converging cone. The cone occupies a considerable portion of the space bounded by the converging filaments 16. Air normally drawn downwardly by the rapidly traveling filaments is constrained by the cone to flow in a smoother non-turbulent fashion to minimize undesired vibration of the filaments. The cone 38 can be secured to the lower end of the conduit 28 in any suitable manner, preferably in a releasable manner, such as by screws, bayonet coupling, etc.

It is preferable that the diameter defined by the innermost circular row of holes in the spinneret be at least 5" to allow sufficient room for the gas supply conduit 26 to pass therethrough. Smaller diameters could be employed, but the gas conduit would then probably be smaller than needed to conduct an optimum gas flow quantity.

If desired, a finishing liquid may be applied to the filaments in the vicinity of a conventional stationary or rotating guide 40 at which the filaments are gathered and redirected.

It is preferable to employ in conjunction with the present invention a circular guide ring beneath the cone and through which the filaments travel. The center of the guide ring would be co-axial with the longitudinal axis of the filament group and would have a diameter less than the diameter which would otherwise be assumed by the filaments. Thus, the guide ring supports the filaments and shortens the free, unsupported length thereof. By so doing, the amplitude of vibration of the filaments is reduced, whereby the filaments are quenched in a more uniform manner. The foregoing guide and its use was invented by another entity.

In operation, the filaments 16 are formed in circular arrays in conventional fashion. Quench air is conducted downwardly through the pack 12 via the conduit 24 and discharged radially outwardly through the group of filaments to cool the latter. Air currents immediately below the conduit 24 are guided in streamlined fashion by the streamlining cone 38. The filaments thus formed and cooled are gathered and redirected at the guide.

It will be appreciated that the present invention eliminates the need for an elbow in the quench gas supply conduit below the quench zone, and thereby eliminates the need for dividing the filaments into separate bundles. As a result, it is generally unnecessary to restrict the size of the gas supply conduit and thus an optimum amount of quench gas flow can be provided. Since it is unnecessary to provide a quenching gas conduit of substantial height below the spinneret, the overall machine height is reduced, and it is also easier to align the quench conduit with the axis of the filament group.

Because the quench gas conduit is mounted on the pack, a constant uniform distance between the spinneret holes and the uppermost quench air stream may easily be maintained, thereby assuring uniform quality and minimal birefringence variability of filaments produced.

The filaments are not subjected to extra wear and tear by rubbing against unlubricated surfaces such as quench elbows. Also, since the filaments need no longer be separated into bundles, air gaps previously formed between the bundles, and which promoted air turbulence around the filaments, no longer exist. Turbulence is further reduced by the presence of the streamlining cone which extends below the outlet of the quench gas duct.

Although the invention has been described in connection with a preferred embodiment thereof, it will be appreciated by those skilled in the art that additions, substitutions, modifications, and deletions not specifically described may be made without departing from the spirit or scope of the invention as defined in the appended claims.

What is claimed is:

1. In a melt-spinning process of the type wherein molten polyester polymer is extruded downwardly through a filter pack and through an annular array of holes of a spinneret to form a circularly arranged group of filaments, quench gas is directed across the filaments emerging from the spinneret, and the filaments are gathered and redirected at a stationary or rotating guide, the improvement wherein essentially all the quench gas is delivered downwardly through said pack and spinneret coaxially relative to and completely within said array of holes and then redirected and discharged radially outwardly through the group of filaments above said guide, thereby bellowing said filaments radially outwardly and minimizing quench gas drag and maximizing quench gas flow, and wherein all said extruded filaments are converged at a common guide, whereby filament birefringence variability is reduced.

2. In a process according to claim 1, wherein molten polymer is passed through a plurality of coaxial circular rows of holes.

3. In a process according to claim 1, which comprises preheating said quench gas to a temperature up to 300° C.

* * * * *